United States Patent [19]

Dirnberger et al.

[11] Patent Number: 4,587,511

[45] **Date of Patent: * May 6, 1986**

[54] ELEVATOR SYSTEM WITH HALL LAMP STATUS MONITORING

[75] Inventors: Linus R. Dirnberger, Randolph; Alan L. Husson, Hackettstown, both of N.J.; Michael J. Brick, Wallingford, Conn.

[73] Assignee: Westinghouse Electric Corp., Pittsburgh, Pa.

[ * ] Notice: The portion of the term of this patent subsequent to Nov. 26, 2002 has been disclaimed.

[21] Appl. No.: 527,920

[22] Filed: Aug. 30, 1983

[51] Int. Cl.[4] ..... B66B 3/00

[52] U.S. Cl. ..... 340/19 R

[58] Field of Search ..... 187/29 R; 340/19 R, 340/825.52, 505

[56] References Cited

U.S. PATENT DOCUMENTS

| | | | |
|---|---|---|---|
| 3,782,504 | 1/1974 | Billmaier et al. | 187/29 R |
| 3,828,892 | 8/1974 | Winkler et al. | 187/29 R |
| 3,841,443 | 10/1974 | Booker, Jr. | 187/29 R |
| 3,903,499 | 9/1975 | Oliver | 340/19 R |
| 4,287,508 | 9/1981 | Arita et al. | 340/825.52 X |
| 4,392,125 | 7/1983 | Iwata | 340/518 |
| 4,463,352 | 7/1984 | Forbes et al. | 340/505 X |

*Primary Examiner*—James L. Rowland
*Assistant Examiner*—Brian R. Tumm
*Attorney, Agent, or Firm*—D. R. Lackey

[57] ABSTRACT

An elevator system in which an elevator car serves the floors of a building under the direction of a car controller. A hall lantern controller and associated hall lamps are located at each floor served by the elevator car. A serial hall lantern riser extends from the car controller past each floor served by the elevator car, with each hall lantern controller being connected to the serial riser. The car controller prepares serial messages for the riser, with each including a command for an identified hall lantern controller. Each hall lantern controller recognizes its own messages, it responds to the associated command, and it sends a serial acknowledgment signal back to the car controller.

4 Claims, 9 Drawing Figures

DOOR OPERATOR
FLOOR HEIGHT TABLE (ROM)
CAR POSITION COUNTER (RAM)
ADVANCED CAR POSITION (RAM)
HALL LANTERN CONTROLLER -2ND. FLOOR-
D.C. REGULATOR
TO SYSTEM PROCESSOR & OTHER CARS
HALL LANTERN CONTROLLER -TOP FLOOR-
HALL LANTERN CONTROLLER -1ST FLOOR-
CAR CONTROLLER
HALL CALL CONTROL
CAR CALL CONTROL
PULSE CONTROL
DRIVE MACHINE
DN
UP
DN
UP
+5V
TOP
2ND
1ST
A
B

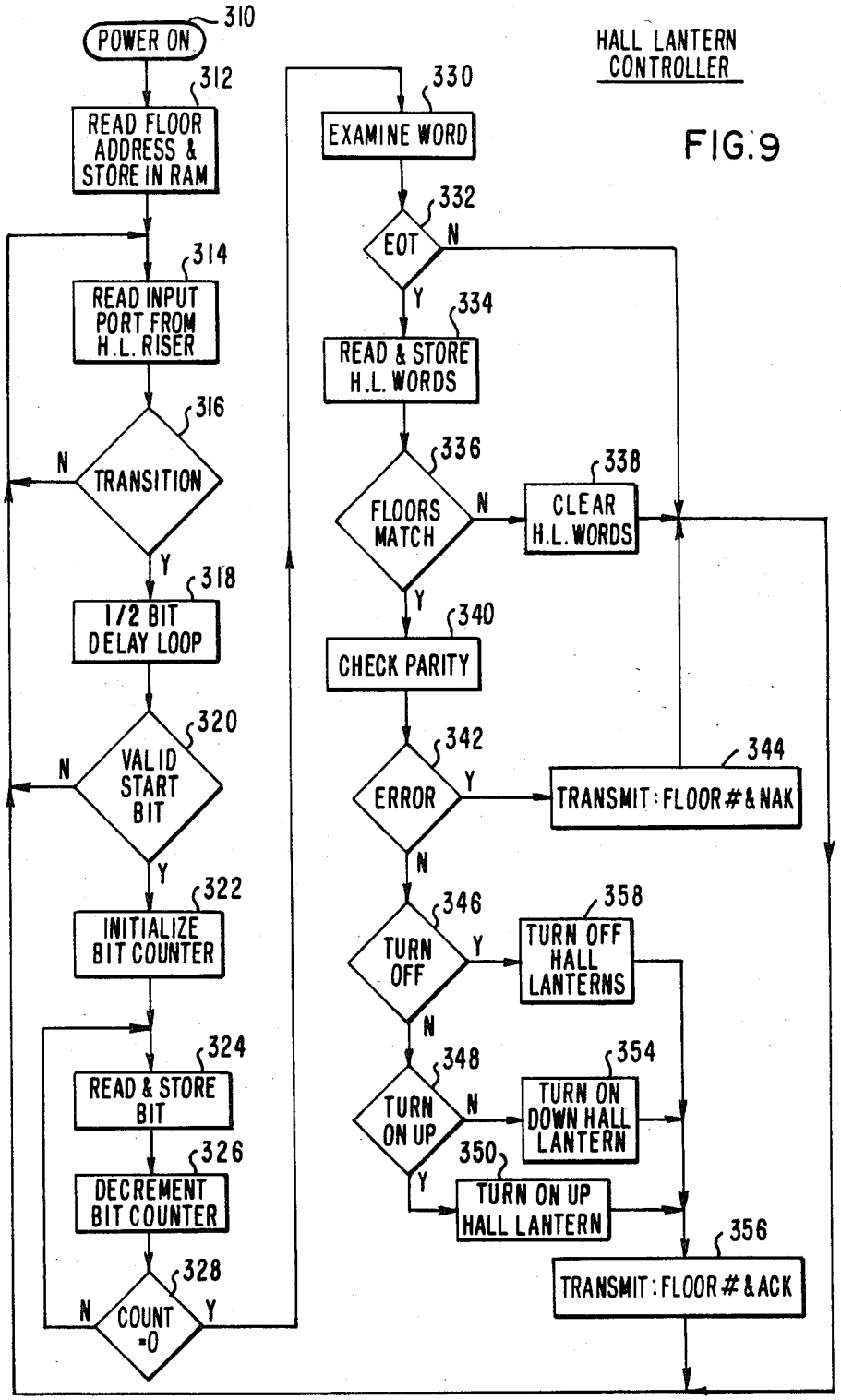
HALL LANTERN CONTROLLER
FIG. 9
POWER ON
310
READ FLOOR ADDRESS & STORE IN RAM
312
READ INPUT PORT FROM H.L. RISER
314
TRANSITION
316
N
Y
1/2 BIT DELAY LOOP
318
VALID START BIT
320
N
Y
INITIALIZE BIT COUNTER
322
READ & STORE BIT
324
DECREMENT BIT COUNTER
326
COUNT =0
328
N
Y
EXAMINE WORD
330
EOT
332
N
Y
READ & STORE H.L. WORDS
334
FLOORS MATCH
336
N
Y
CLEAR H.L. WORDS
338
CHECK PARITY
340
ERROR
342
Y
N
TRANSMIT: FLOOR # & NAK
344
TURN OFF
346
Y
N
TURN OFF HALL LANTERNS
358
TURN ON UP
348
N
Y
TURN ON DOWN HALL LANTERN
354
TURN ON UP HALL LANTERN
350
TRANSMIT: FLOOR # & ACK
356

ELEVATOR SYSTEM WITH HALL LAMP STATUS MONITORING

BACKGROUND OF THE INVENTION

1. Field of the Invention

The invention relates in general to elevator systems, and more specifically to an elevator system having a new and improved arrangement for operating the hall lanterns.

2. Description of the Prior Art

A conventional hall lantern arrangement for each intermediate floor of a building includes two lamps and a gong for each elevator car. The terminal floors each have a single lamp and a gong. Thus, two parallel wires per car are required for each intermediate floor, plus a common wire. This results in a large plurality of parallel wires in the hoistway, adding substantially to the wiring costs upon initial installation, and making trouble shooting time consuming and costly.

Matrix arrangements, such as the arrangement shown in U.S. Pat. No. 3,882,447, which is assigned to the same assignee as the present application, have been developed to reduce the wiring required in the hoistway, but a matrix is a relatively complicated and costly wiring pattern.

Thus, it would be desirable to reduce the hoistway wiring required for the hall lanterns, if it is possible to do so without offsetting disadvantages, such as requiring complicated wiring patterns.

SUMMARY OF THE PRESENT INVENTION

Briefly, the present invention is a new and improved elevator system in which the hall lanterns at each floor of a building are controlled by a hall lantern controller, with the communication between the elevator car controller and the hall lantern controllers being serial. Only three wires are required in the hoistway for full duplex (two way) communication between the car controller and the hall lantern controllers.

Complicated wiring patterns are avoided by utilizing a microcomputer in each hall lantern controller. The logic or intelligence for each hall lantern controller is stored in read-only memory (ROM), and the logic is the same for each floor. Thus, the ROMS are interchangeable. Each hall lantern controller includes an eight-bit DIP switch. Each switch is set to the binary address of the associated floor at the time of installation, and the floor address functions as the unique identification code for each hall lantern controller. The only modification required for the car controller is the addition of a hall lantern module in its operating program, which is placed into bid when the floor selector would ordinarily provide hall lantern control signals. The hall lantern module is then run by the priority executive in due coarse.

The hall lantern module of the car controller prepares commands for a specific hall lantern controller, using the unique floor address or identification code of the hall lantern controller to be communicated with. All of the hall lantern controllers constantly monitor the serial communication link, and when a message is placed on the link by the car controller, each hall lantern controller compares its unique address with the address portion of the message. When the message address matches the unique address of a hall lantern controller, the associated hall lantern controller responds to the remaining portion of the message, checking parity, and responding to the command portion of the message when no transmission error is detected. After the commands are performed, such as "turn-on up hall lantern", "turn-on down hall lantern", or "turn-off hall lanterns", the hall lantern controller sends a message back to the car controller, acknowledging reception and performance of the command.

Should a hall lantern controller detect an error, the hall lantern controller involved transmits a message to the car controller which indicates an invalid reception, and the car controller responds by again transmitting the same message over the serial communication link.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 9 is a flow chart of a program which may be run by each hall lantern controller.

DESCRIPTION OF THE PREFERRED EMBODIMENTS

The invention relates to new and improved hall lantern apparatus for an elevator system. The invention will be described by illustrating only those parts of an elevator system which are pertinent to the understanding of the invention, with the remaining portions of a complete elevator system being incorporated by reference to issued patents assigned to the same assignee as the present application. Accordingly, U.S. Pat. Nos. 3,750,850 and 4,240,527 are incorporated into the specification of the present application by reference. U.S. Pat. No. 3,750,850 sets forth a car controller, including a floor selector and a speed pattern generator. The floor selector of this patent may be used to provide certain signals used by the hall lantern control of the present invention. U.S. Pat. No. 4,240,527 discloses a bidding arrangement and a Priority Executive for placing program modules into bid and running them according to the highest priority program currently bid.

Figure 1:
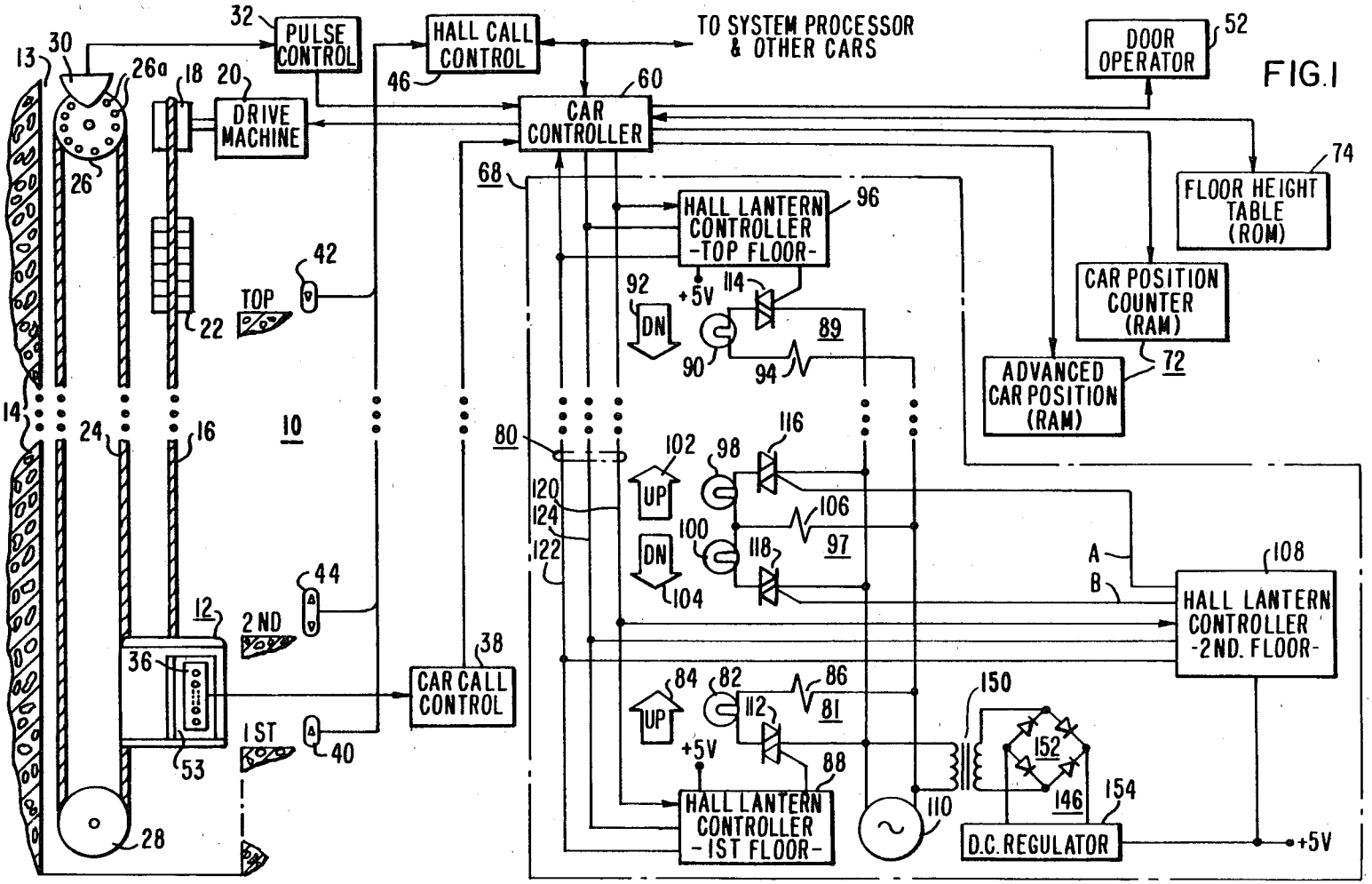
FIG. 1 is a schematic diagram of an elevator system constructed according to the teachings of the invention.
Figure 2:
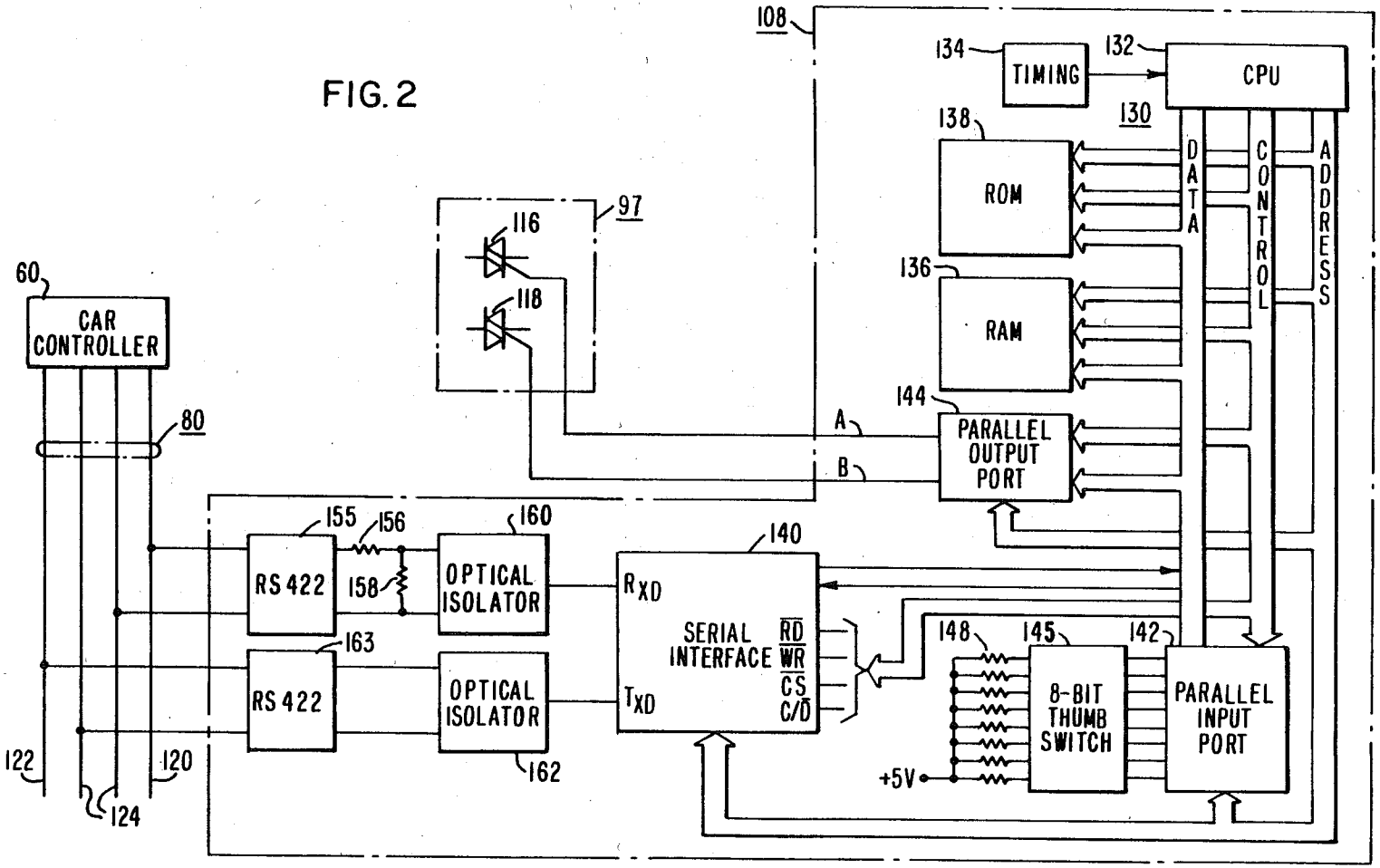
FIG. 2 is a partially schematic and partially block diagram of a hall lantern controller which may be used for the hall lantern controllers shown in block form in FIG. 1.
Figure 3:
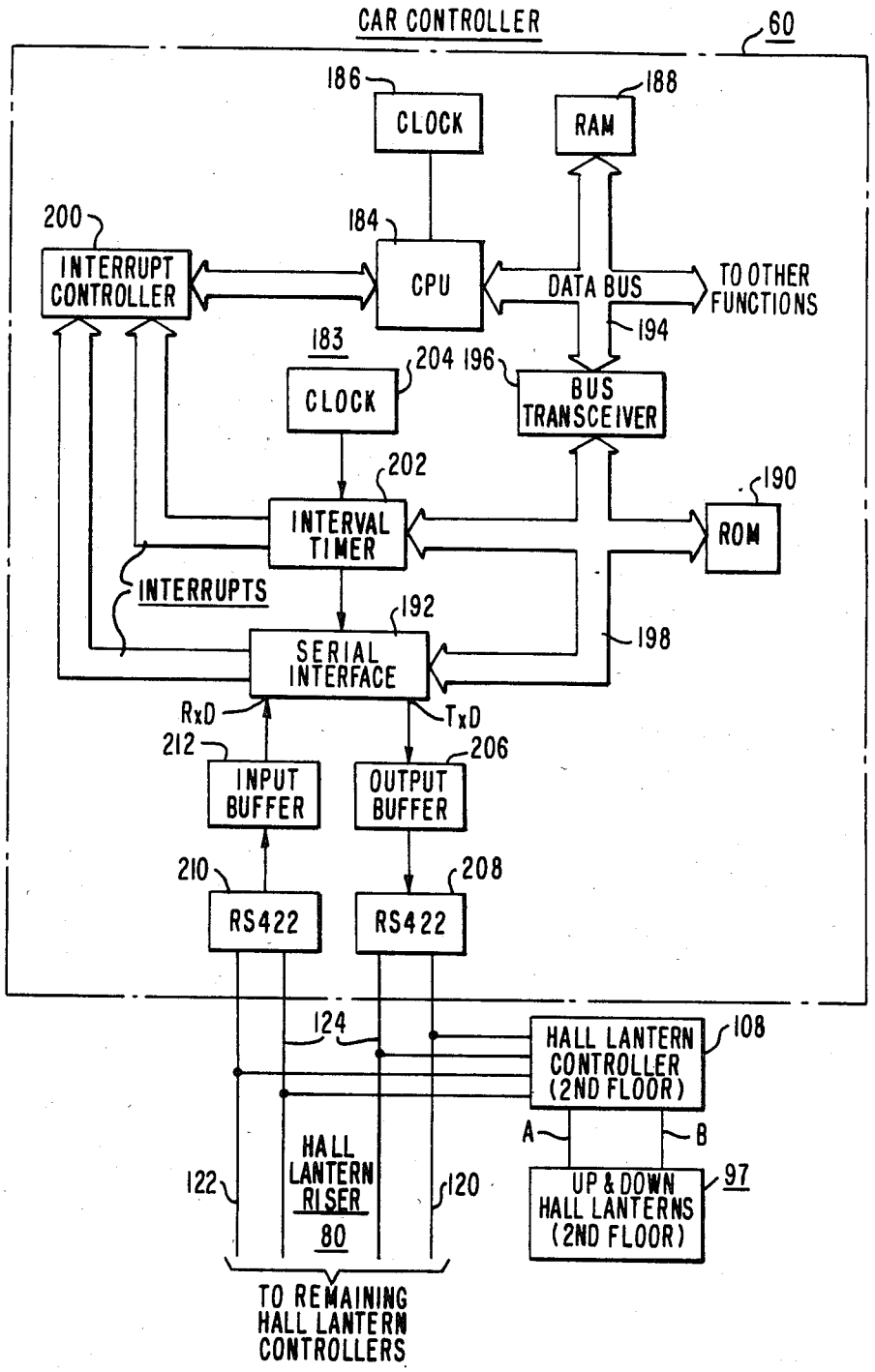
FIG. 3 is a partially schematic and partially block diagram of a car controller which may be used for the car controller shown in block form in FIG. 1.

Referring now to the drawings, FIG. 1 is a schematic diagram of an elevator system constructed according to the teachings of the invention, and FIGS. 2 and 3 expand upon portions of FIG. 1 which are shown in block form.

FIG. 1 illustrates an elevator system 10 which includes an elevator car 12, the movement of which is controlled by a car controller 60, which in turn may be controlled by a system processor (not shown), when the system is under group supervisory control. The car controller 60 includes a floor selector and a speed pattern generator. The floor selector is described in detail in incorporated U.S. Pat. No. 3,750,850. It is sufficient for the understanding of the present invention to state that the floor selector, in addition to providing signals for door control 52, provides signals $\overline{HLU}$, $\overline{HLD}$ and $\overline{DORR}$, which are used by hall lantern control 68. Signals $\overline{HLU}$ and $\overline{HLD}$ are hall lantern enable signals, which, when true, respectively indicate the up and down hall lanterns should be illuminated. Signal $\overline{HLU}$ switches low or true when the floor selector detects that the elevator car 12, when travelling upwardly, should start to decelerate to stop at a floor. Signal $\overline{HLD}$ switches low or true when the elevator car 12, when travelling downwardly, should start to decelerate and stop at a floor. Signal $\overline{DORR}$ switches low or true when the elevator car 12 is stopped at a landing and the door non-interference time expires. Signal $\overline{DORR}$ is used to initiate door closing, and it may also be used as the signal to turn off a hall lantern.

Car 12 is mounted in a hatchway or hoistway 13 for movement relative to a structure 14 having a plurality of floors or landings, with only the first, second and top floors or landings being shown. Car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, as desired. A suitable drive machine 20, along with its associated closed loop feedback control is shown in detail in U.S. Pat. No. 4,277,825, which is assigned to the same assignee as the present application.

A counterweight 22 is connected to the other ends of the ropes 16. A governor rope 24, which is connected to the car 12, is reeved about a governor sheave 26 located above the highest point of travel of the car 12 in the hoistway 13, and over a pulley 28 located at the bottom of the hoistway. A pick-up 30 is disposed to detect movement of the elevator car 12 through the effect of circumferentially-spaced openings 26*a* in the governor sheave 26, or in a separate pulse wheel which is rotated in response to the rotation of the governor sheave. The openings 26A are spaced to provide a pulse for each standard increment of travel of the elevator car 12, such as a pulse for each 0.25 inch of car travel. Pick-up 30 may be of any suitable type, such as optical or magnetic. Pick-up 30 is connected to pulse control 32 which provides distance pulses for the car controller 60.

Car calls, as registered by pushbutton array 36 mounted in the car 12, are processed by car call control 38, and the resulting information is directed to the car controller 60.

Hall calls, as registered by pushbuttons mounted in the hallways, such as the up pushbutton 40 located at the first floor, the down pushbutton 42 located at the top floor, and the up and down pushbuttons 44 located at the second and other intermediate floors, are processed in hall call control 46. The resulting processed hall call information is directed to the car controller 60.

Car controller 60 tabulates the distance pulses from the pulse detector 32 in an up/down counter, such as a counter maintained in random access memory (RAM) 72, to develop information concerning the precise position of the car 12 in the hoistway 13, to the resolution of the standard increment. When the car 12 is level with the lowest floor, the car position count, referred to as POS16, is zero. The POS16 count when the car is level with each floor is used as a first address for the associated floor. A floor height table, in terms of the standard increment, may be maintained in a read-only memory (ROM) 74.

An advanced car position, in terms of the standard increment, may be developed by adding, or subtracting, a count value equal to the required slow-down distance for the current speed of the elevator car. When the advanced car position matches a floor address in the floor height table, the car should immediately initiate slowdown, if the floor is a target floor. This is the point at which the appropriate hall lantern would be enabled, or turned on. If the floor is not a target floor, the advanced floor position for the elevator car 12, referred to as the AVP floor, or simply as AVP, should be incremented, or decremented, depending upon travel direction. The advanced floor position AVP is the closest floor ahead of the elevator car 12 in its travel direction at which the car can stop according to a predetermined deceleration schedule. The target floor, mentioned earlier, is the floor at which the car 12 should stop, to serve a car call or a hall call, or simply to park.

According to the teachings of the invention, the hall lantern control 68 includes a serial hall lantern riser 80, hall lantern means at each floor, such as lamps and a gong, and a hall lantern controller at each floor. For example, the lowest or first floor includes hall lantern means 81 and a hall lantern controller 88. The hall lantern means 81 may include an up direction hall lamp 82, such as an incandescent bulb, or other suitable source of visible electromagnetic radiation, which may illuminate an up direction arrow 84, and a gong 86, or other suitable audible indicator. The top floor includes hall lantern means 89 and a hall lantern controller 96. The hall lantern means 89 may include a down direction lamp 90 which illuminates a down direction arrow 92, and a gong 94. The second floor, and other intermediate floors, may include hall lantern means 97 and a hall lantern controller 108. The hall lantern means 97 may include up and down direction lamps 98 and 100, respectively, which illuminate up and down direction arrows 102 and 104, respectively, and a gong 106.

Each hall lantern controller controls the energization of the hall lantern lamps at its associated floor. For example, a common source 110 of electrical potential, such as an AC source, and a solid state switch for each lamp, may be used, such as switch 112 for the first floor, switch 114 for the top floor, and switches 116 and 118 for the second floor. Switch 116, for example, may connect lamp 98 and gong 106 across source 110, while switch 118 may connect lamp 100 and gong 106 across source 110. The solid state switches may be triacs, which trigger or turn on when gate drive current is applied to its gate electrode, and which turn off at the first voltage zero crossing following removal of gate drive. The gate electrodes are controlled by the associated hall lantern controller, with the hall lantern controller providing gate drive current when a lamp should be energized, and removing gate drive current when the lamp should be deenergized.

The various hall lantern controllers are located at their associated floors, and they all receive command signals over the serial hall lantern riser 80. Hall lantern riser 80 includes a conductor 120 for serial message transmissions from the car controller 60 to the plurality of hall lantern controllers, a conductor 122 for serial message transmissions from the hall lantern controllers to the car controller 60, and a common conductor 124. Conductors 120, 122 and 124 extend from the car controller 60, which may be located in the machine room, through hoistway 13, past all of the floors, for easy connection to each of the hall lantern controllers. The hall lantern controllers are of similar construction, and thus only the hall lantern controller 108 for the second floor is shown in detail.

More specifically, as shown in FIG. 2, each hall lantern controller is preferably implemented by a digital computer 130, and more specifically by a single chip microcomputer 130, such as Intel's 8748. Microcomputer 130, for example, includes a central processing unit (CPU) 132, system timing or clock 134, a random access memory (RAM) 136, a read-only memory (ROM) 138, a serial interface 140 for communication with the riser 80, a parallel input port 142 for receiving a unique identification code, and a parallel output port 144 having latchable outputs for controlling the state of the associated hall lanterns or lamps.

The unique identification code for each hall lantern controller is preferably provided by an eight-bit thumb DIP switch 145, which is connected to a source 146 of unidirectional potential via eight resistors, indicated generally at 148. The unidirectional potential may be provided by source 146 shown in FIG. 1, having a transformer 150 connected to AC source 110, a full-wave, single-phase, bridge rectifier 152, and a DC regulator 154.

Conductor 120 of the serial data riser 80 may be connected to an input terminal RxD of serial interface 140 via an RS422 header 155, input resistors 156 and 158 and an optical isolator 160, such as HP 4N30. Input resistors 156 and 158 allow the use of any desired voltage on the riser 80, by proper selection of their values. The output terminal TxD of serial interface 140 may be connected to conductor 122 of riser 80, via an optical isolator 162, and an RS422 header 163.

In order to maintain gate drive current for a selected solid state switch, without the necessity of providing a new gate drive signal each voltage half cycle of source 110, parallel output port 144 may be of the type which has latchable outputs, or it may be used in conjunction with suitable memory devices, such as flip-flops. For purposes of example, it will be assumed that parallel output port includes latchable outputs A and B. Output A is connected to the gate electrode of solid state switch 116, and output B is connected to the gate electrode of solid state switch 118. When lamp 98 is to be energized, CPU 132 provides a signal for parallel output port 144 which latches its output A at the logic one level. CPU controls lamp 100 in a similar manner, causing output port B of parallel output port 144 to be latched at the logic one level, when lamp 100 is to be energized. The gong 106 sounds when an associated lamp is initially energized. If it is desired to sound the gong twice for one travel direction, such as down, and once for the opposite travel direction, CPU 132 would set the associated latch twice in succession when two sounds are to be generated.

FIG. 3 is a partially schematic and partially block diagram which illustrates the serial communication hall lantern riser 80 and its connections to the car controller 60. Car controller 60 may include a single board microcomputer 183, such as Intel's iSBC80/24 TM, having a CPU 184, such as Intel's 8085A microprocessor. The clock 186, such as Intel's 8224, provides system timing. Microcomputer 183 further includes a random access memory (RAM) 188, a read-only memory (ROM) 190, and a serial interface 192, such as Intel's 8251A. CPU 184 communicates with RAM 188, and its many other functions, via a data bus 194. A bus transceiver 196, such as Intel's 8287, may interface bus 194 with a bus 198, with bus 198 serving ROM 190 and the serial interface 192.

The CPU 184 may be interrupt driven, directly through its on-board interrupt inputs, and any additional interrupts may be handled via an interrupt controller 200, such as Intel's 8259A. An interval timer 202, such as Intel's 8253, and a clock 204, such as Intel's 8224, provide timing for interface 192, and it also provides additional interrupts for the interrupt controller 200.

Serial interface 192 provides an interrupt request to the interrupt controller 200 when it is ready to transmit information, and it also provides an interrupt request when it has received information and is ready to transfer it to a memory address to be provided by CPU 184.

Serial interface 192 includes a serial output port TxD which is connected to a buffer or driver 206 and to an RS422 header 208. Driver 206 may be Motorola's MC34878. Header 208 is connected to conductors 120 and 124 of the hall lantern riser 80. Serial interface 192 also includes a serial input port RxD. Conductors 122 and 124 of hall lantern riser 80 are connected to input RxD via an RS422 header 210 and a buffer or receiver 212. Receiver 212 may be Motorola's MC34868. Clock 204, interval timer 202, serial interface 192, driver 206, receiver 212 and headers 208 and 210 may be mounted on a separate board, such as Intel's iSBX351 TM Serial Module TM Board which may be plugged into the 80/24 Board.

Figure 4:
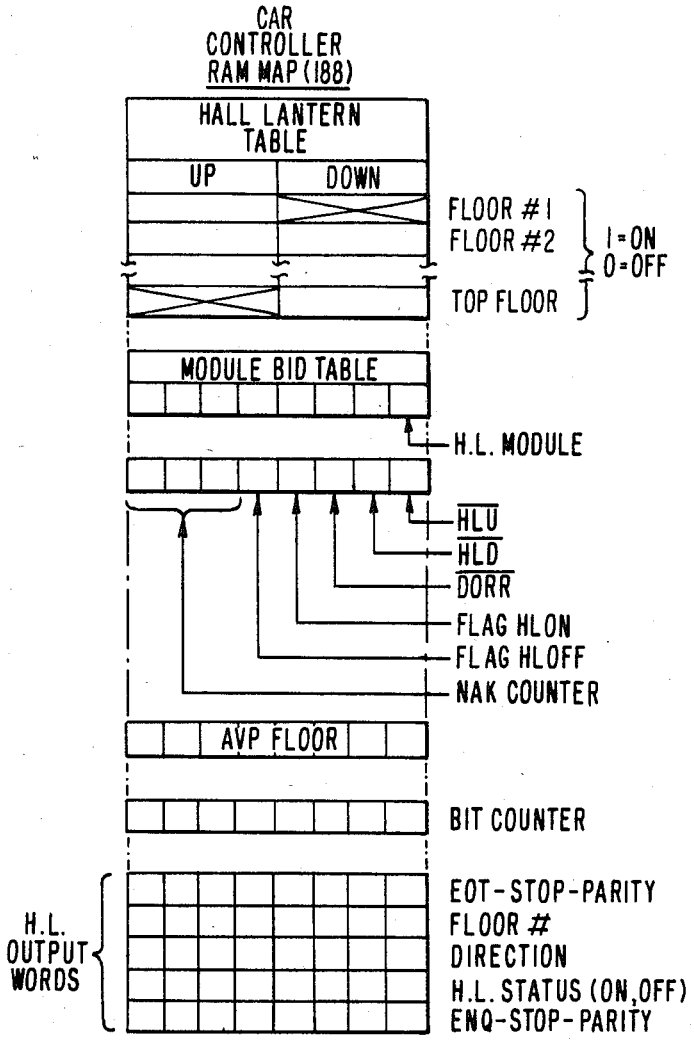
FIG. 4 is a RAM map of the car controller RAM, which illustrates the various signals and tables stored therein by the hall lantern module.
Figure 5:
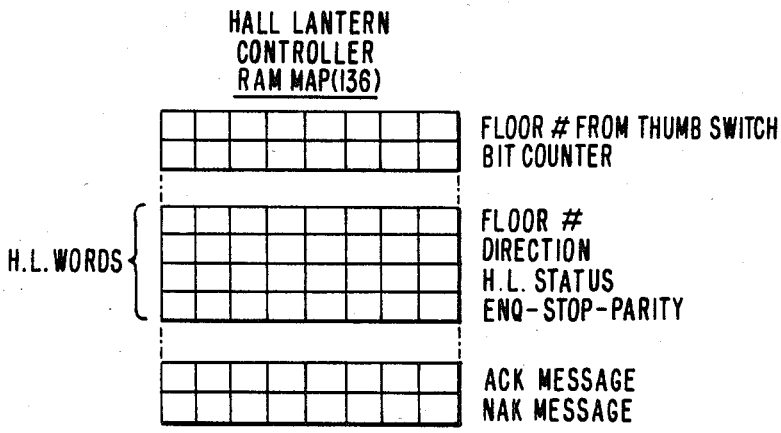
FIG. 5 is a RAM map of a hall controller RAM, which illustrates the signals stored therein by a hall lantern controller.

FIGS. 4 and 5 set forth exemplary RAM map formats of RAMS 188 and 136, respectively, of the car controller 60 and hall lantern controller 108, which will be referred to when describing the remaining Figures related to programs stored in ROMS 190 and 138.

Certain of the time operating programs of car controller 60 may be in the form of independent modules which are run only when there is a need to run them, and then they are run in a predetermined priority sequence when more than one module has a need to run at any one time. When a need to run for a particular module is detected, such as by another module, or by a hardware interrupt, the program is placed into bid. FIG. 4 sets forth an exemplary format for a module bid table. The module may also place itself into bid, at the completion of its running. The program for linking modules placed into bid in a predetermined priority order is called the priority executive program, with this arrangement being described in greater detail in incorporated U.S. Pat. No. 4,240,527.

Figure 6:
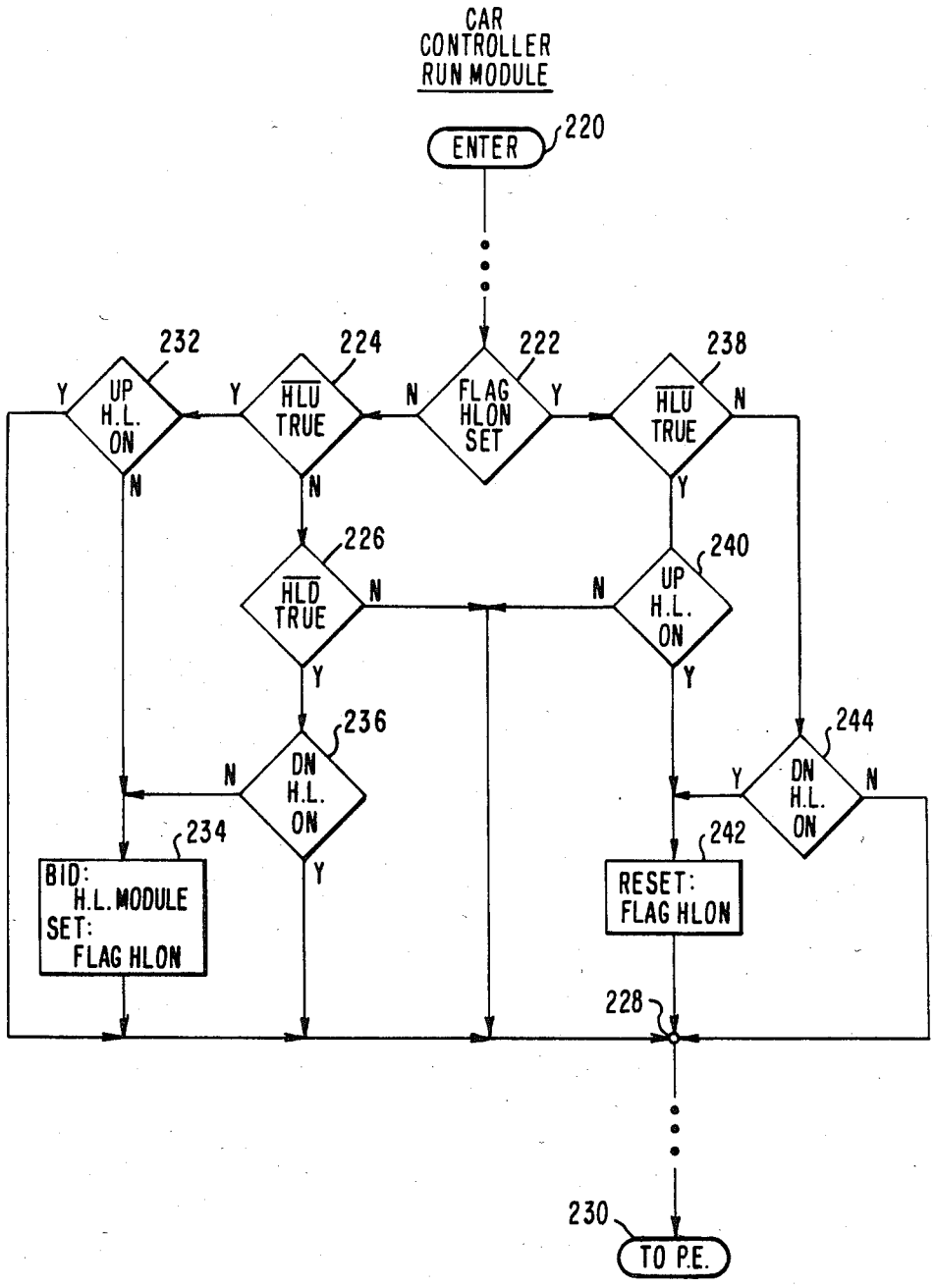
FIG. 6 is a flow chart of a modification with which may be made to the RUN function of a car controller, to signify when a hall lantern should be illuminated.
Figure 8:
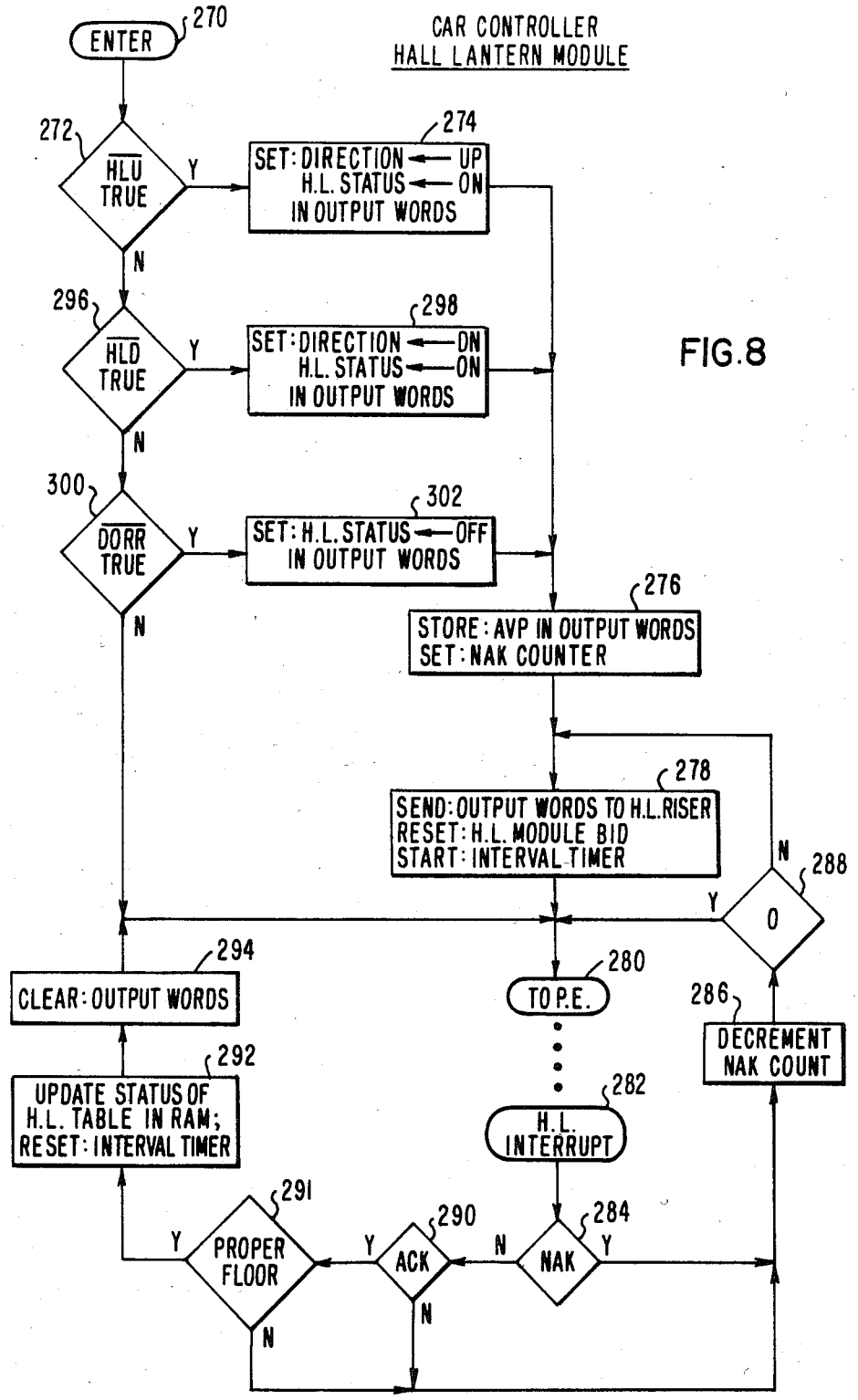
FIG. 8 is a flow chart of a hall lantern module which may be placed into bid by the flow charts set forth in FIGS. 6 and 7, and run by the Priority Executive.

FIG. 6 is a detailed flowchart which may be an integral part of a RUN module of the car controller 60, which controls each run of the elevator car 12. The RUN module, or an equivalent hardware logic function, such as shown in incorporated U.S. Pat. No. 3,750,850, provides true signals $\overline{HLU}$ are e,ovs/HLD/ when the up and down hall lanterns, respectively, should be illuminated. The signals are stored in RAM 188 shown in FIG. 4. A flag HLON, also shown in RAM 188 of FIG. 4, is used to indicate when a hall lantern module has been placed into bid. The hall lantern module, which is shown in FIG. 8, is run when a hall lantern should be turned on, or off, and it will be hereinafter explained.

More specifically, the RUN module of FIG. 6 is entered at 220, and during its running, step 222 will be encountered which checks the status of flag HLON. If flag HLON is not set, it means the hall lantern module has not been placed into bid, and the program proceeds to check to see if it should be placed into bid. Step 224 checks to see if $\overline{HLU}$ is true, indicating a request to turn on an up hall lantern. If it is not true, step 226 checks signal $\overline{HLD}$. If it is not true, the program proceeds to terminal 228, ending the hall lantern portion of the module. Module RUN eventually completes its running, and returns to the priority executive (PE) at exit 230. If step 224 finds signal $\overline{HLU}$ true, step 232 checks the up hall lantern status stored in RAM 188 (FIG. 4). If it is already on, step 232 proceeds to terminal 228. If it is not on, step 234 places the hall lantern module into bid by setting bit position zero of the bid table shown in FIG. 4, and it sets flag HLON, also shown in FIG. 4 to signify the hall lantern module has been placed into bid. Step 234 proceeds to terminal 228.

If step 226 finds signal $\overline{HLD}$ true, step 236 checks the status of the down hall lantern, proceeding to terminal 228 if it is already on, and proceeding to step 234 if it is not. If step 222 finds flag HLON set, the program then determines if the hall lantern module has been run and the appropriate hall lantern illuminated. Step 238 checks to see if $\overline{HLU}$ is true. If it is, step 240 checks the status of the up hall lantern in RAM 188 (FIG. 4). If it is not on, step 240 proceeds to terminal 228. If it is on, step 240 proceeds to step 242, which resets flag HLON. Step 242 proceeds to terminal 228.

If step 238 finds $\overline{HLU}$ is not true, signal $\overline{HLD}$ must be true and step 244 checks the status of the down hall lantern. If it is not on, step 244 proceeds to terminal 228, and if it is on, flag HLON is reset in step 242.

The next time the program is run, step 222 will find flag HLON not set, one of the signals $\overline{HLU}$ or $\overline{HLD}$ true, and the associated hall lantern on, and simply bypass step 234.

Figure 7:
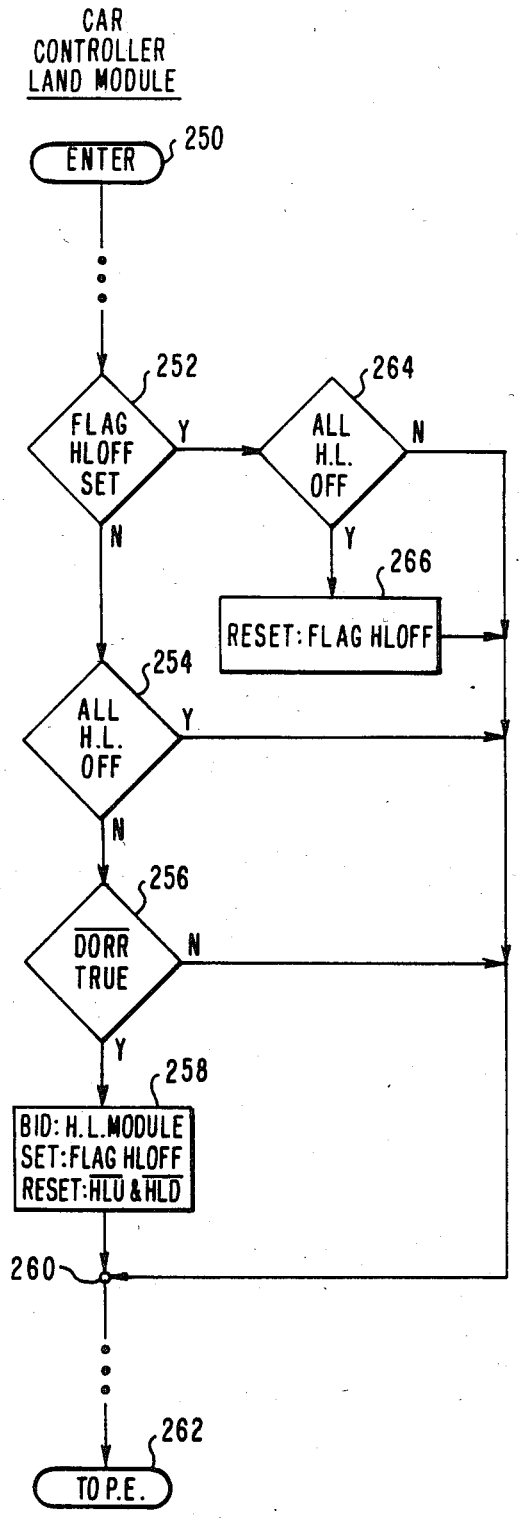
FIG. 7 is a flow chart of a modification which may be made to the LAND function of a car controller, to signify when a hall lantern should be turned off.

When car 12 stops at a floor, a program module LAND, shown in FIG. 7, may be run periodically. Module LAND, among other things, checks to determine when the hall lantern module, shown in FIG. 8, should be placed into bid, in order to turn off a hall lantern. This module may monitor the hall lantern enable signals $\overline{HLU}$ or $\overline{HLD}$, or it may monitor the door close request $\overline{DORR}$, which is driven low or true to request the door operator to close the car and hatch doors. The energized hall lantern should be turned off at the time the doors are requested to close.

More specifically, module LAND is entered at 250, and step 252 checks a flag HLOFF stored in RAM 188, as shown in FIG. 4. Flag HLOFF is set to signify that a hall lantern should be turned off, and that the hall lantern module shown in FIG. 8 has been placed into bid in order to accomplish this function. At this point, it will be assumed that step 252 finds flag HLOFF is not set, and step 254 checks the status of the hall lanterns, such as by checking a status table in the RAM shown in FIG. 4. If a hall lantern is on, step 256 checks RAM 188 to see if signal $\overline{DORR}$ is true. If it is true, step 258 places the hall lantern module into bid by setting bit position zero of the module bid table in RAM 188, it sets flag HLOFF, and it resets $\overline{HLU}$ and $\overline{HLD}$ in RAM 188. Step 258 proceeds to terminal 260, and eventually to the exit terminal 262. If step 256 finds signal $\overline{DORR}$ not true, it proceeds to terminal 260, bypassing step 258.

If step 252 finds flag HLOFF not set, and step 254 finds the hall lanterns are both off, step 254 proceeds to terminal 260.

If step 252 finds flag HLOFF set, step 264 checks the status of the hall lanterns in RAM 188. If a hall lantern is on, step 264 proceeds to terminal 260. If all hall lanterns are off, step 264 proceeds to step 266, which resets flag HLOFF.

The hall lantern module of the car controller 60 shown in FIG. 8 is run, in its proper priority order, once it has been placed into bid by the RUN or LAND modules shown in FIGS. 6 and 7, respectively. It is entered at terminal 270 and step 272 checks RAM 188 to see if signal $\overline{HLU}$ is true. If it is, step 274 prepares appropriate hall lantern output words in RAM 188 by setting the direction character to "up" and the status character to "on". Step 276 further prepares the hall lantern output words by checking the AVP floor in RAM 188, i.e., which is now the floor at which the car 12 is going to stop, and it loads the floor number, in binary, into the appropriate hall lantern word in RAM 188. Step 276 also sets a software counter NAK in RAM 188 to a predetermined count, such as three. Step 278 sends the output words to the serial interface 192, when serial interface 192 indicates it is ready to transmit. It may make this indication via an appropriate interrupt line to the interrupt controller 200. Step 278 also resets the hall lantern module "bid" in RAM 188, and it starts the interval timer 202. Interval timer 202 will be programmed to generate an interrupt at the end of a preset time. If the hall lantern module of the car controller has not noted an acknowledgement that the appropriate hall lantern controller has received the message by the time the interrupt occurs from the interval timer 202, the message will be repeated. Step 278 then returns to the PE at 280.

A hall lantern interrupt will be vectored to terminal 282. A hall lantern interrupt means one of three things: (1) no response has been received from a hall lantern controller and the interrupt was generated by the interval timer; (2) a response NAK was received from a hall lantern controller which indicates a hall lantern controller recognized that the message was addressed to it, but a parity error was detected; or (3) a response ACK was received from a hall lantern controller which recognized the message as being directed to it, no error was detected, and the hall lantern controller performed the requested command. Thus, step 284 checks to see if an NAK message was received. If so, step 286 decrements the NAK count. The NAK counter makes sure the program breaks out of the message repeat loop in the event some malfunction in transmission occurs. Step 288 checks to see if the NAK count has been decremented to zero. If not, step 278 repeats the message. If the NAK count is zero, the message is not repeated. Step 288 may proceed directly to terminal 280, or may first proceed to an appropriate step which will alert maintenance personnel that there is a problem.

If step 284 finds that it was not an NAK caused interrupt, step 290 checks to see if it was an ACK caused interrupt from the hall lantern controller associated with the proper floor. If not, then it was an interrupt from the interval timer 202, or the response was not from the addressed hall lantern controller, and step 290 proceeds to step 286.

If step 290 finds an ACK interrupt from the correct hall lantern controller, step 292 updates the status of the hall lantern in question in the hall lantern status table stored in RAM 188 (FIG. 4), and it resets the interval timer so it will not time out and provide an interrupt. Step 294 clears the hall lantern output words stored in RAM 188, and it returns to the PE.

If step 272 finds signal $\overline{HLU}$ is not true, step 296 checks signal $\overline{HLD}$. If it is true, step 298 prepares the hall lantern words by setting the direction character to "down" and the hall lantern status character to "on". The command is then further processed as hereinbefore described relative to the $\overline{HLU}$ request.

If step 296 finds $\overline{HLD}$ is not true, step 300 checks to see if signal $\overline{DORR}$ is true. If it is, step 302 sets the hall lantern status character to "off" in the hall lantern words, and this command is further processed as described relative to the $\overline{HLU}$ command.

If step 300 finds $\overline{DORR}$ is not true, the program simply returns to the PE at 280.

FIG. 9 is a flowchart of a hall lantern program which is run repeatedly by each hall lantern controller, since they may be dedicated controllers having no other tasks to perform. It is entered at 310 when power is turned on, and it initializes itself in step 312 by reading and storing its unique address, i.e., input port 142 is read to determine the address provided by the DIP switch 144. Step 312 proceeds to step 314 which reads the serial input port 140 connected to the hall lantern riser 80. It checks for a start sequence. When there is no message being transmitted, i.e., the data lines BREAK condition, it will detect a space or zero voltage level. To initiate a message transmission, a MARK (predetermined voltage level above zero) must precede the standard "start", or space-going transition. Step 316 checks for a transition and loops back through step 314 until it detects one. When a transition is detected, step 318 provides a delay loop equal to one-half of the serial data clock period, and then step 320 resamples the input. This serves to check that the initial transition was not caused by noise, by moving the sampling point to what should be the center of a valid data bit.

If step 320 detects a valid start bit, step 320 proceeds to step 322. If a valid start bit is not detected, step 320 returns to step 314.

Step 322 initializes a bit counter in RAM 136 (FIG. 5), and eight bits of data are read in sequentially to RAM 136, to form the first input byte. Steps 324, 326 and 328 provide this function. Step 330 then examines this first word. The first word must be the "master" initiation of transmission command EOT. This word, received with correct parity and a valid stop, will initiate the reading of the next four data words, in the same manner as the first word was received. Thus, step 332 checks to see if it is a valid EOT. If not, it proceeds to step 314. If it is a valid EOT, step 334 reads and stores the next four data words, following a sequence similar to steps 322, 324, 326 and 328. The first word may be the floor address in binary of the addressed floor, the second word may signify the up or down direction, and the third word may signify the requested status, i.e., on or off, and the last word may terminate the message with an ENQ, stop, and parity bit.

Step 336 checks to see if the floor address in the transmission matches its own unique address. If the address is not its own, step 338 clears the hall lantern words in RAM 136 and returns to step 314. If step 336 finds the addresses match, step 340 checks parity. Step 342 determines if there has been an error in transmission. If so, step 344 sends its address and message NAK to the output port 140 for serial transmission over the hall lantern riser 80 to the car controller 60.

If step 342 finds no error, step 346 checks the status command in the appropriate input word. If it finds that it is not a "turn-off" request, step 348 checks to see if it is a "turn-on" request for the up hall lantern 98. If so, step 350 turns on the up hall lantern by causing output port A to go high, of the parallel output port 144. Step 356 then transmits the address of the hall lantern controller and the message ACK over the serial hall lantern riser 80.

If step 348 finds that the turn-on request is not for the up hall lantern, the turn-on request is for the down hall lantern, and step 354 turns on the down hall lantern 100 by causing output B of parallel port 144 to go high. Step 354 then proceeds to step 356.

If step 346 finds a turn-off command, step 358 turns off the energized hall lantern by causing both output ports A and B of port 144 to go to the logic zero level.

In summary, there has been disclosed a new and improved elevator system in which the hall lanterns of a building, for each elevator car, are controlled by a total of three wires. The three wires form a serial hall lantern riser between the car controller of the elevator car, and a hall lantern controller located at each floor served by the elevator car. Each hall lantern controller may be implemented by a single chip microcomputer, with each having a similar logic program stored in its read-only memory, making the ROMS interchangeable. The only non-standard feature of each hall lantern controller is a unique identification number, which is provided by an eight-bit DIP switch. The floor address in binary may be used for this unique identification number, with this floor address simply being dialed into the associated DIP switch of the hall lantern controller.

We claim as our invention:

1. An elevator system, comprising:

a building having a plurality of floors, an elevator car mounted for movement in said building, car controller means for directing said elevator car to serve floors of said building, hall lamp means at each floor served by said elevator car, hall lantern controller means at each floor served by said elevator car, each of said hall lantern controller means including a digital computer for preparing commands which selectively control the associated hall lamp means, and hall lantern riser means having first, second and third conductors extending between said car controller means and said hall lantern controller means with said third conductor being common to the first and second conductors, said car controller means including a digital computer for preparing and transmitting serial command messages over the first conductor of said hall lantern riser means, with each serial command message addressing a predetermined one of said hall lantern controller means, and including commands for the addressed hall lantern controller means, the digital computer of each of said hall lantern controller means including means for recognizing its command messages, means for performing the associated commands, and means for transmitting a serial message over the second conductor, the digital computer of said car controller means including means for maintaining a hall lamp status table in response to messages on the second conductor, with said digital computer being responsive to both the status of the elevator system and the hall lamp status table when preparing serial command messages for said hall lantern controller means, said first, second and third conductors handling all serial communications between said car controller means and said hall lantern controller means, regardless of the number of said hall lantern controller means, each of said hall lantern controller means including error detecting means for detecting an error in a command message it recognizes as being directed to it, said means for transmitting a serial message over the second conductor transmitting a first serial message to the car controller means in response to detection of an error in a command message by said error detecting means, and a second serial message to the car controller means when no command message error is detected, after the associated hall lantern controller means performs the requested command, said car controller means including means for retransmitting the same command message over the first conductor in response to receiving said first serial message from a hall lantern controller means on the second conductor, said means for maintaining a hall lamp status table including means for maintaining the requested status of each hall lamp means, with said car controller means updating said requested status in response to each command message which is followed by the reception of said second serial message from the associated hall lantern controller means.

2. The elevator system of claim 1 wherein the means associated with each hall lantern controller means for recognizing its serial command messages includes means for providing a unique identification code, and means for recognizing its own unique identification code in a serial command message transmitted over the first conductor of the hall lantern riser means, wherein the means associated with each hall lantern controller means for performing commands, performs only those commands in a serial message which includes its unique identification code, and wherein the car controller means includes means for including the correct unique identification code in each serial command message for a selected hall lantern controller means.

3. The elevator system of claim 1 wherein the hall lamp means for each floor includes a separate lamp for each service direction provided for that floor by the elevator car, and wherein the command messages include lamp turn-on commands which identify a predetermined service direction, and a lamp turn-off command which requests that any energized lamp be turned off.

4. The elevator system of claim 1 wherein each hall lantern controller means includes switch means for selecting an identification code, with the hall lantern controller means all being of like construction, except for the identification code selected by its associated switch means.

* * * * *